US006210142B1

(12) United States Patent
Huesers et al.

(10) Patent No.: US 6,210,142 B1
(45) Date of Patent: Apr. 3, 2001

(54) APPARATUS FOR CONSTRUCTING A SNOW SHELTER

(75) Inventors: Edward A. Huesers, 348 Park St., Lyons, CO (US) 80540; Guy A. Menge, Longmont, CO (US)

(73) Assignee: Edward A. Huesers, Lyons, CO (US)

( * ) Notice: Subject to any disclaimer, the term of this patent is extended or adjusted under 35 U.S.C. 154(b) by 0 days.

(21) Appl. No.: 09/036,907

(22) Filed: Mar. 9, 1998

(51) Int. Cl.[7] ..... B28B 17/00

(52) U.S. Cl. ..... 425/60; 425/63; 425/441; 264/32; 264/33; 264/34

(58) Field of Search ..... 425/60, 63, 441; 52/80.1; 264/32, 33, 34

(56) References Cited

U.S. PATENT DOCUMENTS

| | | | | |
|---|---|---|---|---|
| 1,995,692 | * | 3/1935 | Urschel | 425/63 |
| 2,877,530 | | 3/1959 | Winn | 425/60 |
| 3,372,430 | | 3/1968 | Lowes | 425/60 |
| 3,376,602 | | 4/1968 | Lowes | 425/60 |
| 3,619,431 | * | 11/1971 | Weaver et al. | 264/32 |
| 3,790,321 | * | 2/1974 | Bunger | 264/33 |
| 3,966,533 | | 6/1976 | Goldsworthy et al. | 156/379.8 |
| 4,154,423 | | 5/1979 | Crock | 249/134 |
| 4,193,750 | | 3/1980 | Nielson | 425/60 |
| 4,371,325 | * | 2/1983 | Harbison | 264/32 |
| 4,734,021 | | 3/1988 | Maddock | 425/60 |
| 4,795,332 | | 1/1989 | Davis | 425/60 |
| 5,497,974 | | 3/1996 | Tapang | 249/74 |
| 5,655,260 | * | 8/1997 | Chang | 16/113.1 |

* cited by examiner

*Primary Examiner*—Harold Pyon
*Assistant Examiner*—Donald Heckenberg
(74) *Attorney, Agent, or Firm*—Pittenger & Smith, P.C.

(57) ABSTRACT

A method and apparatus for constructing a shelter from ice or snow. A slip form allows snow or ice to be formed in situ into building blocks that form the shelter. The slip form comprises two vertical side pieces and incorporates an end cap that holds the side pieces together and allows the slip form to separate upon impact rather than fracture. A telescoping pole is attached at one end to one of the side pieces of the slip form, and at the other end to a spike that is driven into the ground to provide a reference point for the construction of the shelter. The telescoping pole incorporates two or more sections. The first section comprises a series of predetermined apertures that receive a tab or pin integrated into the second section of the telescoping pole. The outer diameter of the second section is smaller than the inner diameter of the first section, thus allowing the pole to retract by placing the second section into the first section. The pole can remain fixed at different lengths by placing the tab into the apertures in succession, thus guiding the slip form and the courses being formed through orientations that allow the shelter to take a desired enclosed shape.

25 Claims, 8 Drawing Sheets

APPARATUS FOR CONSTRUCTING A SNOW SHELTER

FIELD OF THE INVENTION

The present invention relates to construction of shelters made from snow or ice. More specifically, the present invention relates to the advantage of using a slip form attached to a telescoping pole to construct a structure having an ellipsoidal shape.

BACKGROUND OF THE INVENTION

Shelters built from snow or ice may serve a variety of important functions. In areas that receive heavy snowfalls, where there are virtually no building materials available other than snow or ice, such shelters may provide humans with life-saving insulation from cold or other natural elements. Snow shelters are indispensable in times of emergency, and are often used in recreational applications, such as winter camping or ice fishing.

Building a shelter from snow or ice is a difficult job that requires a significant amount of skill. The shelter generally assumes the shape of a dome and is either sculpted from compacted snow or built from specially shaped blocks. Such blocks are cut from ice or compacted snow. The blocks must be angled slightly as they are stacked in circles of successively smaller diameters, so that they form an enclosure at the top of the shelter.

Molds have been used in the prior art to provide building blocks by packing the mold with snow or ice. These molds provide blocks of consistent shape, but generally require the user to make the block with the mold, and then place and adjust the block at the required location. Using conventional snow molds is difficult and impractical for several reasons. First, the size of the block requires the user to repeatedly lift considerable weight to complete the shelter. The resulting demand on human muscles in an already harsh environment saps normal human strength fairly quickly. Second, the weight of the snow packed mold can easily fracture such a mold when it is dropped. Third, the shape of the shelter is entirely determined by the user, and once a mistake is made, it is very difficult, if not impossible, to correct the mistake by repositioning the blocks already in place.

A slip form, wherein the block of snow or ice may be formed in place, has been found to solve the problem of lifting a heavy block to an elevated position. An empty slip form can easily be placed where the block is desired. The user may pack the slip form with snow or ice, and then remove the slip form while leaving the block in place. Smaller quantities of ice or snow may be lifted to the desired location, thus preserving a person's strength and reducing the risk of injury. However, a slip form alone cannot guide the placement of blocks to yield a structurally optimal shape for the snow or ice structure.

There is a great need for a relatively simple device that can be used without excessive physical effort to guide the construction of a shelter from snow or ice.

PRIOR ART DISCLOSURE STATEMENT

U.S. Pat. No. 3,372,430, issued to Lowes on Mar. 2, 1968, discloses a method for constructing an ellipsoidal shelter using a telescoping boom that is connected to a base having a pivot that allows rotation of the telescoping boom incorporating a depositing head that deposits construction material in the form of an elongated strip in a hemispherical configuration.

The present invention is far less complicated than the '430 patent, and incorporates a slip form rather than a depositing head. Also, the '430 patent also does not teach the use of snow or ice as a building material.

U.S. Pat. No. 3,376,602, issued to Lowes on Apr. 9, 1968, improves upon the '430 patent by eliminating the cable required to control the depositing head, achieving a smoother movement through the desired shape and a better deposition of building material. However, the '602 patent still does not teach the use of a slip form, nor the use of snow or ice as a building material. Both the '430 and '602 patents teach inventions requiring substantial power, which are both far more complicated than the present invention.

U.S. Pat. No. 4,734,021, granted to Maddock on Mar. 29, 1988, discloses a machine for building a dome or sphere using an extruder in the form of a centrally located boom that extrudes a wall of a hemisphere by squirting a fluid from the end of the boom. The fluid hardens upon extrusion as the boom travels around a center axis. However, there is no mention of adjusting the length of the boom to provide a spherical or dome shape, nor would such an invention lend itself to the application of building a shelter from snow.

U.S. Pat. No. 4,154,423, issued to Crock on May 15, 1979, discloses two molds for use in forming blocks of snow or ice to be used in constructing a domed shelter such as an igloo. The molds are used to form blocks having different shapes, for use at different points on the shelter. The present invention differs significantly by incorporating a pole that supports the slip form and extends to successive, graduated lengths to provide the critical shape of the shelter.

U.S. Pat. No. 5,497,974, issued to Tapan on Mar. 12, 1996, also discloses a pair of molds or forms for constructing a geodesic igloo. The shapes of these molds are significantly different from the single mold of the present invention, and do not provide in situ forming of building blocks as taught by the present invention. Also, the '974 patent does not teach the use of a telescoping pole to support the slip form and guide the shaping of the shelter.

SUMMARY OF THE INVENTION

The present invention achieves a significant advance over the prior art by providing a method and apparatus for constructing an ellipsoidal shelter from ice or snow. An ellipsoidal shape is critical to the support of the shelter. The present invention achieves the ellipsoidal shape of the shelter by guiding the placement of a slip form through a series of orientations that, when combined, allow the placement of blocks that form the ellipsoidal shape.

The present invention provides apparatus for constructing an ellipsoidal shelter from ice or snow by providing a slip form which allows snow or ice to be formed in situ into building blocks that form the shelter. The slip form comprises two vertical side pieces and incorporates an end cap that holds the side pieces. A graduated, telescoping pole is attached at one end to one of the side pieces of the slip form, and at the other end to a spike or anchor that is driven into the ground to provide a central reference point for the construction of the shelter. The graduated, telescoping pole incorporates two sections. The first section comprises a series of apertures that receive a retractable tab or pin integrated into the second section of the telescoping pole. The outer diameter of the second section is smaller than the inner diameter of the first section, thus allowing the pole to retract by placing the second section into the first section. The pole can remain fixed at different lengths by placing the tab or pin into the apertures in succession, thus guiding the slip form through orientations from the central reference point that allow the shelter to take an ellipsoidal or any other shape desired.

In another aspect, the present invention provides a method for constructing a shelter from ice or snow. The method comprises the steps of locating a first end of a pole at a desired central reference point, attaching a second end of a pole to a slip form, using the slip form to form blocks in a circle at the distance defined by the length of the pole, adjusting the pole to different lengths, and at each length using the slip form to form blocks in a circular course, wherein the blocks rest on the blocks below at an angle defined by the length of the pole. Preferably, the base of the structure is formed by placing blocks of increasing height in a circle, such that successive courses of blocks are placed in a sequential spiraling manner.

DETAILED DESCRIPTION OF THE DRAWINGS

Figure 1:
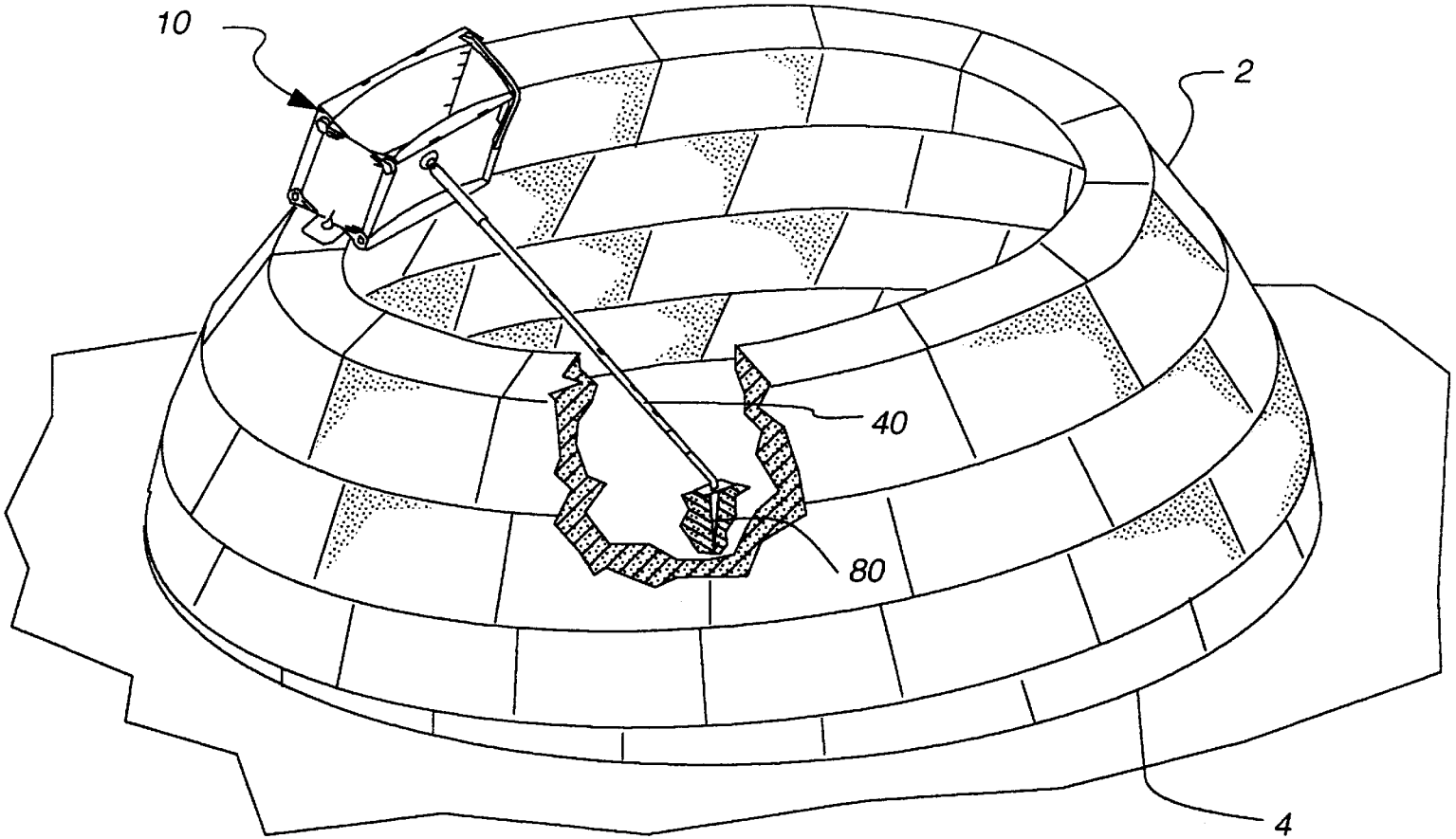
FIG. 1 is a pictorial diagram of the present invention as used to construct a shelter from snow or ice.
Figure 2:
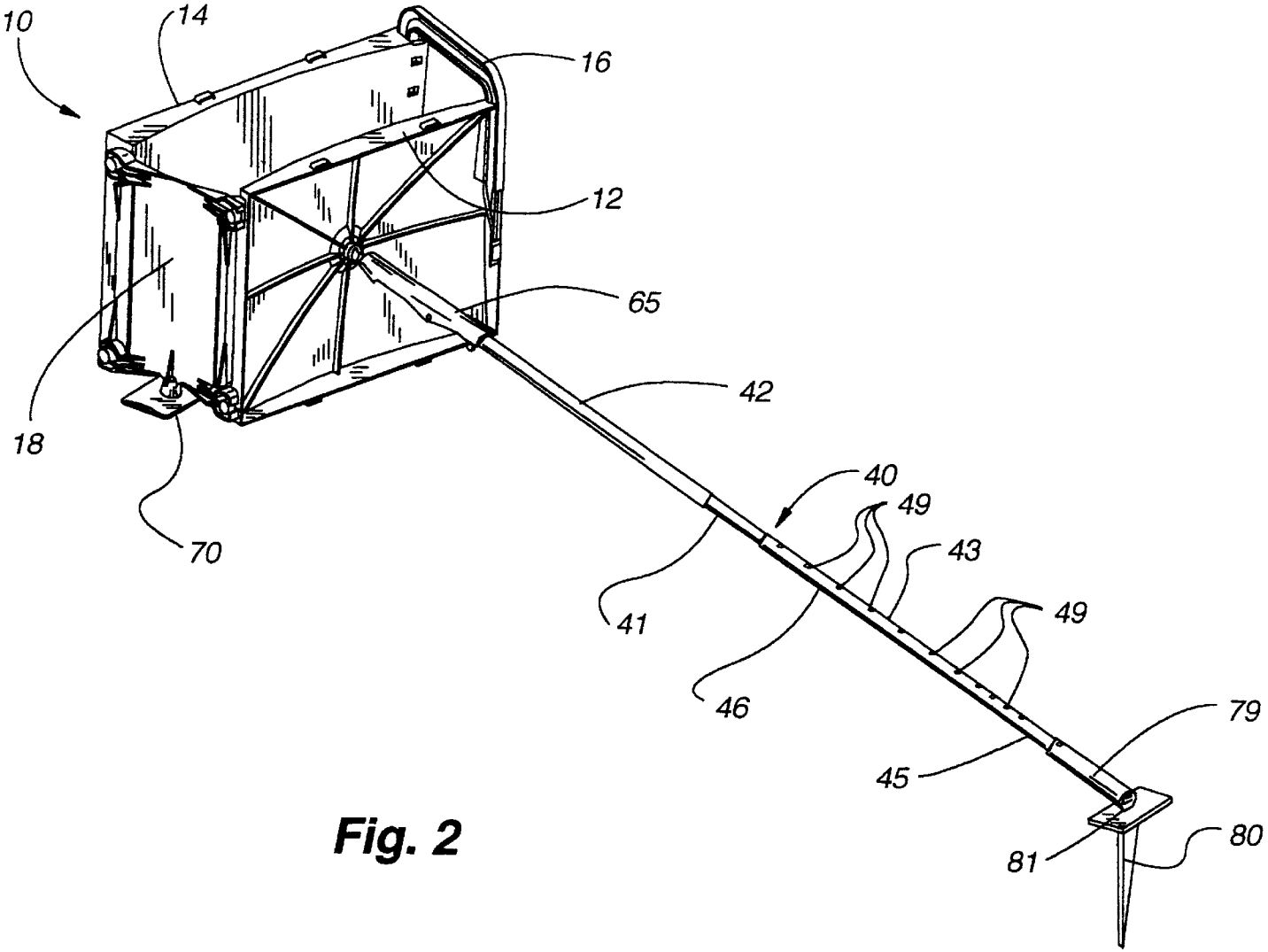
FIG. 2 is a pictorial diagram of the related components of the claimed invention.

The present invention may be used to construct a shelter 2 as illustrated in FIG. 1. FIG. 2 illustrates the related components of the present invention. A slip form 10 is connected to a support pole 40. The support pole 40 is connected to a spike 80, which is driven into the ground or layer of snow or ice that can serve as the floor of the shelter. The slip form 10 is packed with snow or ice to form in situ a building block for the shelter, and then is moved off of the packed snow or ice block to an adjacent location, where the next building block is formed. After rotating the slip form and support pole through a sufficient number of positions to form a circular course of building blocks, the support pole is adjusted to a desired length, and another circle of building blocks are formed on top of the preceding circle of blocks. A shelter may be constructed by repeatedly adjusting the length of the support pole to form circles of building blocks in successive layers on top of each other.

In the preferred embodiment, the first course of blocks at the base of the shelter 2 comprises blocks of increasing height to form a wedge or ramp that will allow the shelter 2 to be constructed in a spiraling manner. The wedge 4 is formed by partially filling the slip form 10 with snow or ice, and moving the slip form to the next adjacent position where a taller block is formed. This pattern is repeated until a full-sized block is completed.

Figure 3:
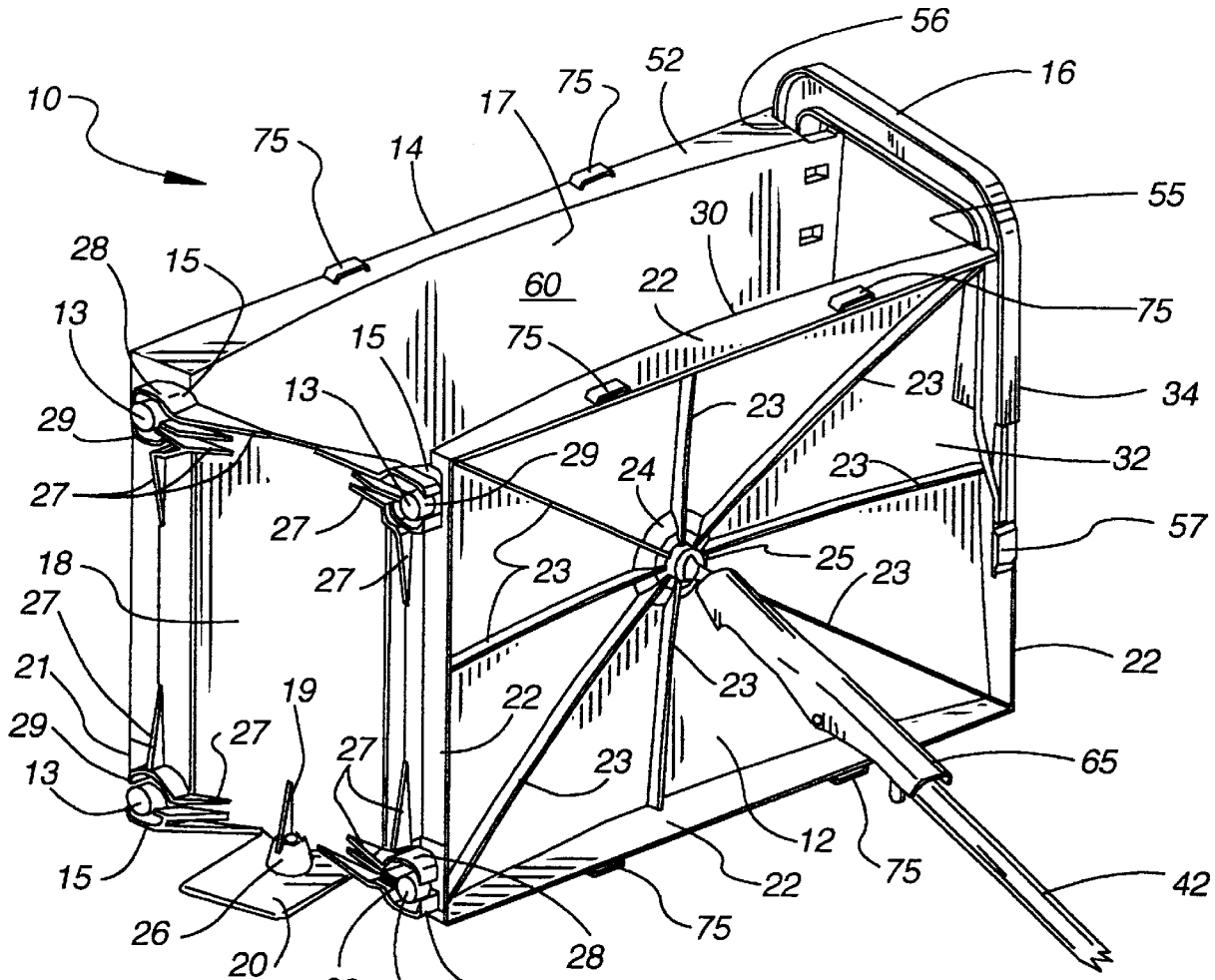
FIG. 3 is a perspective view showing the slip form and toggle release.

FIG. 3 illustrates the slip form 10. The slip form 10 is used to form snow or ice into a desired shape for constructing a shelter. The slip form 10 comprises an interior sidewall 12, an exterior sidewall 14, a cross member 16 and an end cap 18. The sidewalls 12 and 14 are held in an opposing orientation by cross member 16 and end cap 18. Snow or ice is inserted and packed into the cavity 17 defined by the sidewalls 12 and 14 and end cap 18. The sidewalls 12 and 14 may be textured on the opposing faces 30 and 60 to provide gripping surfaces that prevent snow in the slip form 10 from shifting or dislocating while the slip form 10 is being packed. End cap 18 is located at the forward most part of the slip form 10 and prevents snow from spilling out of the forward end of the slip form 10. The adjacent block of snow or ice prevents the snow or ice from spilling out of the rear end of the slip form 10. The space beneath cross member 16 is open to allow the slip form to be moved away from the packed snow in cavity 17. Once the slip form 10 has been packed with snow and then moved away from its initial position to an adjacent position, the packed snow at the initial position prevents snow or ice from spilling out of the open end 34 beneath cross member 16.

The interior sidewall 12 may have a generally rectangular profile that is defined by the support rails 22. The support rails 22 have arcuate or curved edges that together define the convex inner surface 30 of interior sidewall 12. A connecting swivel socket 25 is located at the center of the outer surface 32 of the interior sidewall 12 and receives the ball connector 67 located at the end of release toggle 65. Release toggle 65 connects the slip form 10 to the support pole 40. The socket 25 is reinforced by a snap ring 24 that surrounds the socket 25. A series of braces 23, originating at a plurality of locations around the snap ring 24 and extending in radial directions to the support rails 22, provide support to interior sidewall 12. However, the braces 23 allow enough flexibility in the interior sidewall 12 that the release toggle 65 may remove the interior sidewall 12 from contact with the packed snow in cavity 17, thus allowing the slip form 10 to be moved easily to an adjacent position.

Figure 4:
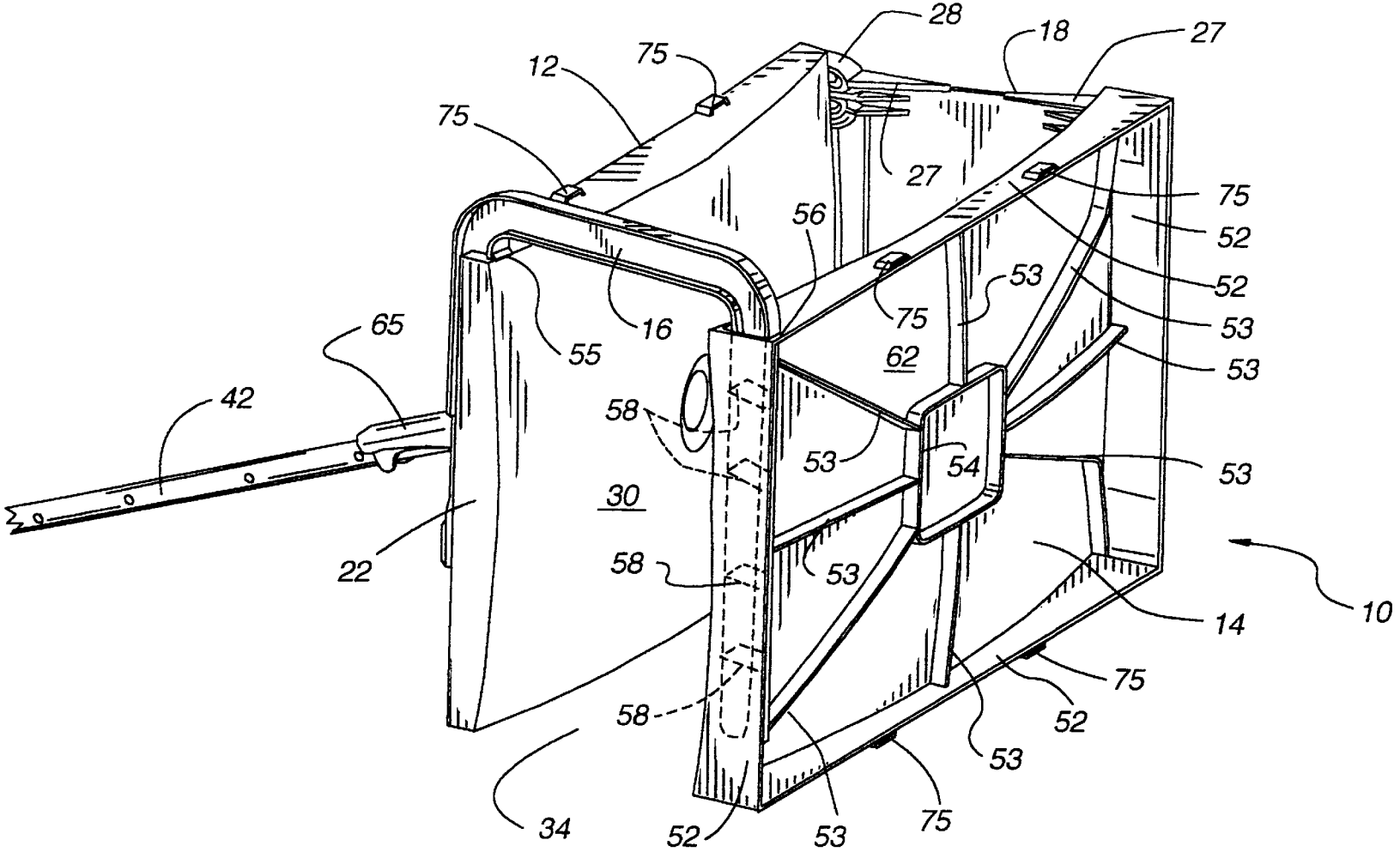
FIG. 4 is a reverse perspective view showing the slip form shown in FIG. 3.

Exterior sidewall 14 also has a rectangular profile that is defined by support rails 52. The support rails 52 have arcuate edges that together define the concave inner surface 60 of exterior sidewall 14. Directing attention to FIG. 4, a central brace 54 is located at the center of the outer surface 62 of the exterior sidewall 14. Braces 53, originating at a plurality of locations around the central brace 54 and extending in radial directions to support rails 52, provide support to the exterior sidewall 14. Both interior sidewall 12 and exterior sidewall 14 have slotted tabs 75 located on their top and bottom support braces. These slotted tabs may be used for a variety of purposes, including strapping the slip form 10 onto a backpack.

Cross member 16 provides support between the interior sidewall 12 and the exterior sidewall 14. Cross member 16 is a "U" shaped piece that may be inserted into the aperture 55 in the interior sidewall 12 and the aperture 56 in the exterior sidewall 14. Upon insertion, the cross member 16 provides a support that spans the open end 34 above the interior sidewall 12 and exterior sidewall 14. Tab 57 impedes cross member 16 from dislocating from sidewall 12 and sidewall 14, thus allowing cross member 16 to be used as a handle for lifting and moving the slip form to a desired position.

Figure 5:
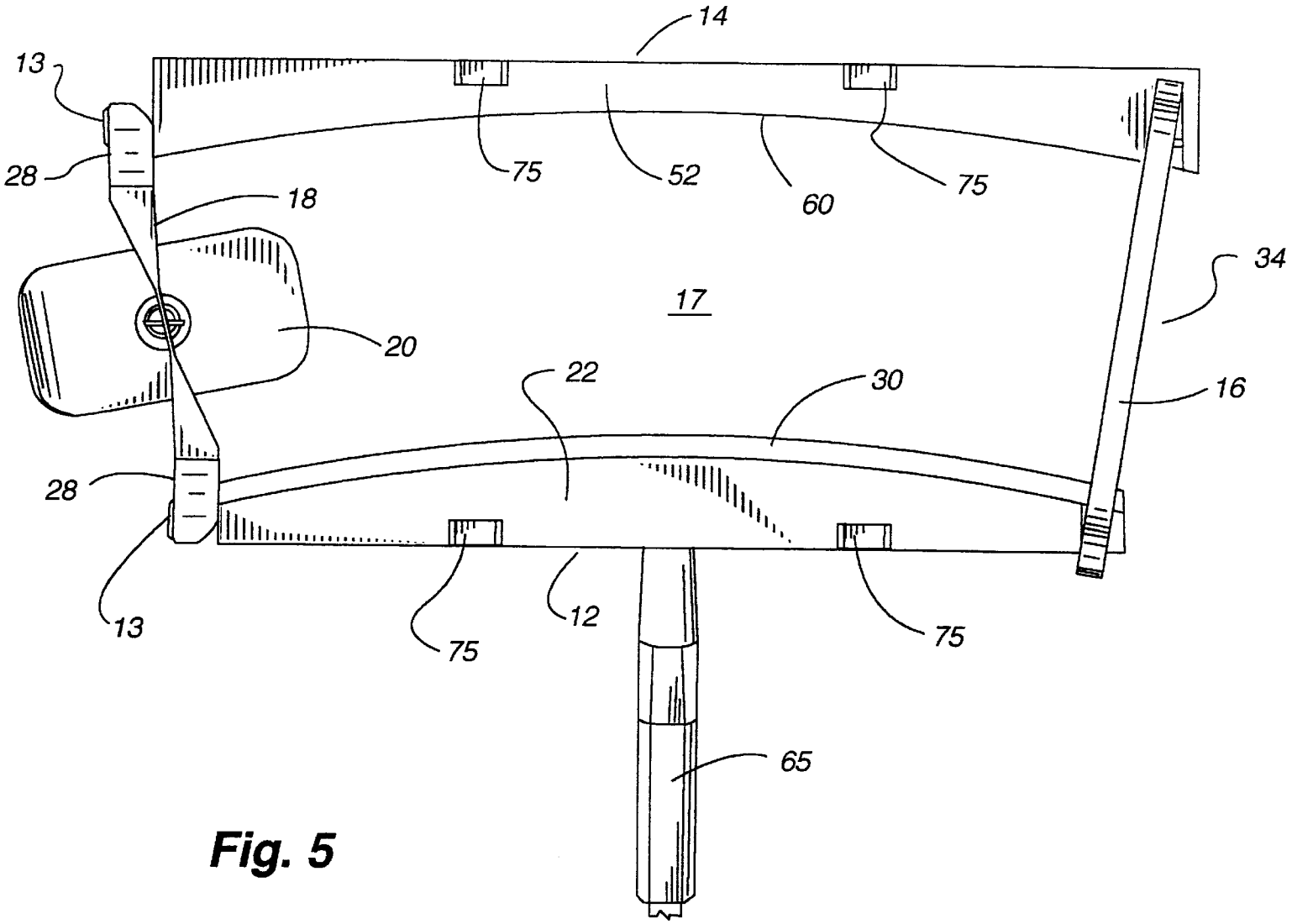
FIG. 5 is a plan view of the slip form.

End cap 18 attaches to sidewalls 12 and 14 via posts 13 that connect to mated clasps 15. As illustrated in FIG. 5, end cap 18 is formed to incorporate an angle which allows end cap 18 to attach in a perpendicular position to interior sidewall 12 and exterior sidewall 14. Clasp 15 is located at a plurality of locations that define the four corners of end cap 18. Clasp 15 incorporates ribs 27, which provide strength and support to end cap 18. Clasp 15 also incorporates two opposing flanged surfaces 28, which define an inner diameter 29. Posts 13 are located at the top and bottom corners of interior sidewall 12 and exterior sidewall 14, such that posts 13 are mated with clasps 15 when end cap 18 is fitted to interior sidewall 12 and exterior sidewall 14. The diameters of post 13 slightly exceed the inner diameters 29 of clasps 15, causing the flanged surfaces 28 of clasps 15 to flex slightly and tightly clasp the posts 13. The fitting of posts 13 into clasps 15 provides a secure connection between end cap 18 and sidewalls 12 and 14. However, in the event that the slip form 10 is somehow dropped or delivered a sharp blow when it is packed with snow, such an impact will cause the posts 13 to dislocate from the clasps 15 while preventing the fracture of other parts of the slip form 10. In the preferred embodiment, the posts 13 and clasps 15 are constructed from nylon, but other durable, semirigid materials, such as ABS, polycarbonate, kevlar, or other similar materials capable of withstanding low temperatures may be used. It is also to be understood that any type of release connector may be used to join the end cap 18 to the side walls 12 and 14.

Figure 6B:
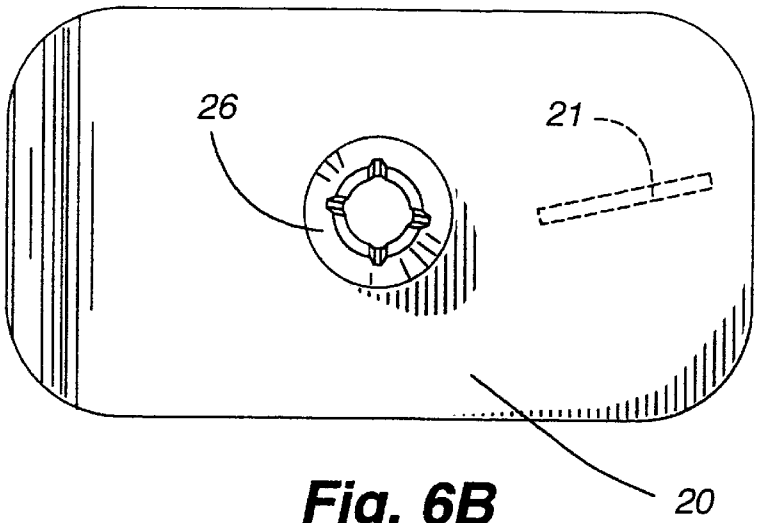
FIG. 6B is a plan view of the shoe.

A shoe 20 may be attached to the bottom edge of end cap 18. The shoe 20 is shaped similar to a short ski with its front tip curved upward and guides the slip form 10 over snow or ice as it is moved through a circular path, See FIG. 6A. The shoe 20 is attached to the end cap 18 via a socket connector 26 that is connected to a rib 19 integrated into the end cap 18. The socket connector 26 is notched to receive the rib 19 and the bottom edge of the end cap 18.

As shown in FIG. 5, the interior sidewall 12 has a convex profile and exterior sidewall 14 has a concave profile, thus cavity 17 has an arcuate or curved shape to form the circular or curved shape of the shelter. The shoe 20 may be canted at an angle from the end cap 18 to describe the circular path through which the slip form 10 is rotated.

Figure 6C:
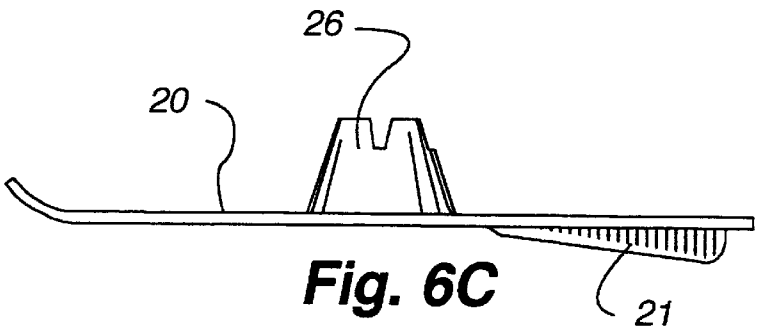
FIG. 6C is a side view of the shoe.
Figure 6A:
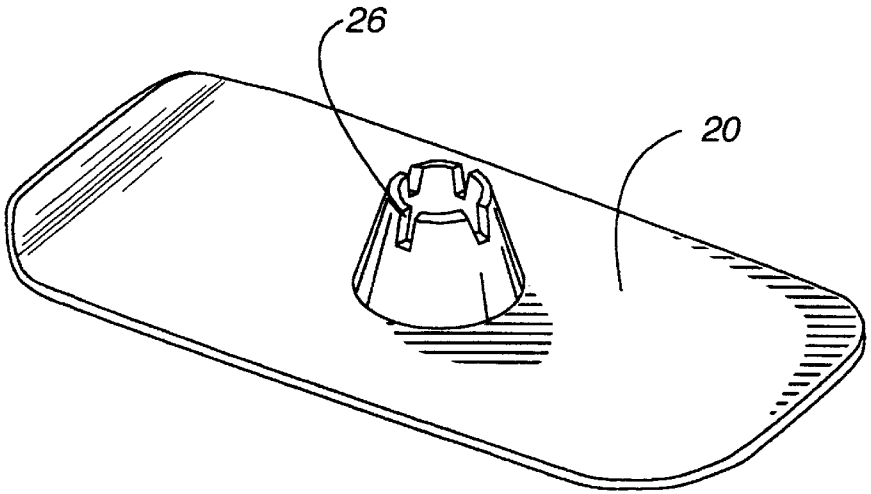
FIG. 6A is a perspective view showing the shoe used with the slip form.

Directing attention to FIG. 6C, a keel 21 is integrated into the bottom surface of the shoe 20 and extends downward from the bottom of the shoe 20. The keel 21 is canted at an angle from the median of the shoe 20, as in FIG. 6B, to facilitate the rotation of slip form 10 through its circular path.

The support pole 40 is illustrated in FIG. 2. The support pole 40 connects to the slip form 10 and the spike 80, thus providing support and a reference by which the slip form 10 is located. The support pole 40 is a telescoping unit that may be adjusted to a plurality of different lengths. By adjusting the length of the support pole 40 as successive courses of building blocks are constructed, a self supporting shelter having an ellipsoidal or spherical shape may be constructed. The support pole comprises an inner pole 41, a first outer pole 42, and a second outer pole 43. The inner diameters of outer pole 42 and outer pole 43 slightly exceed the outer diameter of inner pole 41, thus the inner pole 41 may be slidably inserted into outer poles 42 and 43. Spring loaded pins 44 are included at both ends of inner pole 41. Both outer pole 42 and outer pole 43 contain a series of apertures 49, each aperture 49 is sized to receive the spring loaded pin 44. By positioning the inner pole 41 such that the spring loaded pin 44 may be inserted and locked into place within an aperture 49, the supporting pole 40 may be adjusted to a desired length. While the spring loaded pin 44 only needs to be moved through the apertures 49 of one outer pole, both of the outer poles 42 and 43 may contain a similar series of apertures 49. The sequential location of the apertures 49 establishes the predetermined length of the pole at each step to produce the desired dimensions for the positioning of each course to form the overall shape of the desired shelter.

Figure 9C:
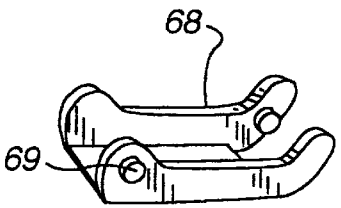
FIG. 9C is a perspective view showing the inner lever of the toggle release.
Figure 9B:
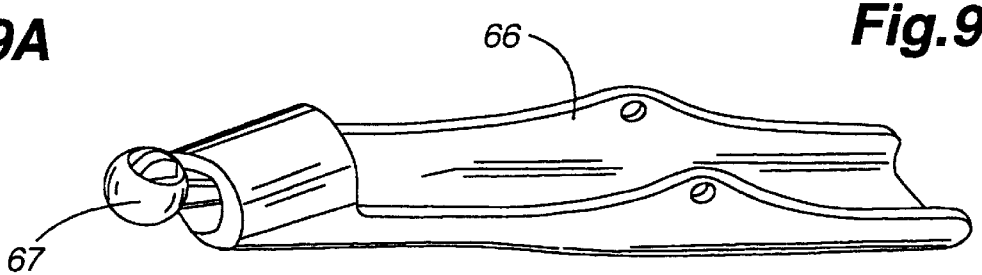
FIG. 9B is a perspective view showing the outer lever of the toggle release.
Figure 7:
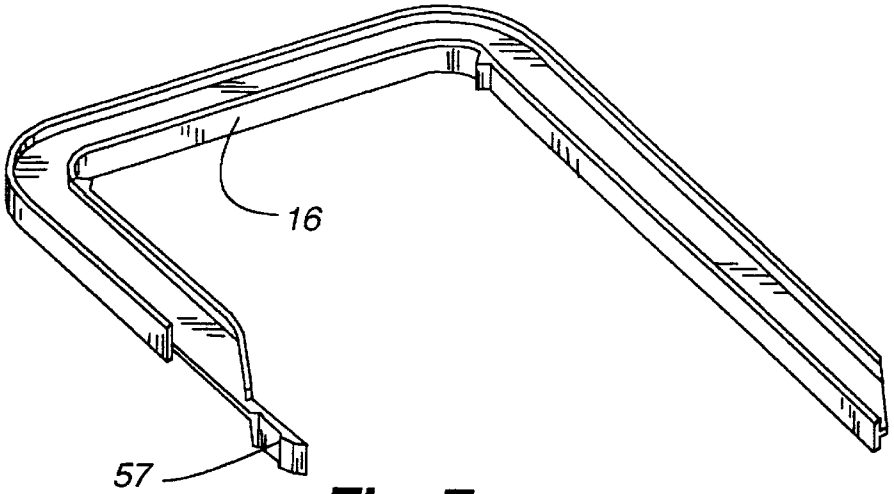
FIG. 7 is a perspective view of the cross member for holding the slip form.
Figure 9A:
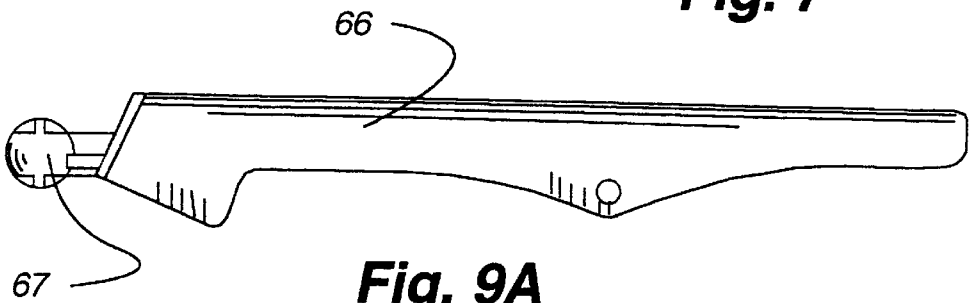
FIG. 9A is a side view of the outer lever of the toggle release.
Figure 10:
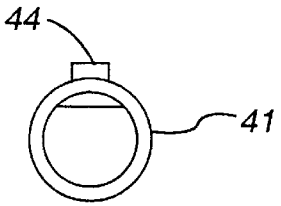
FIG. 10 is an end view showing the inner support pole and spring loaded pin.
Figure 9D:
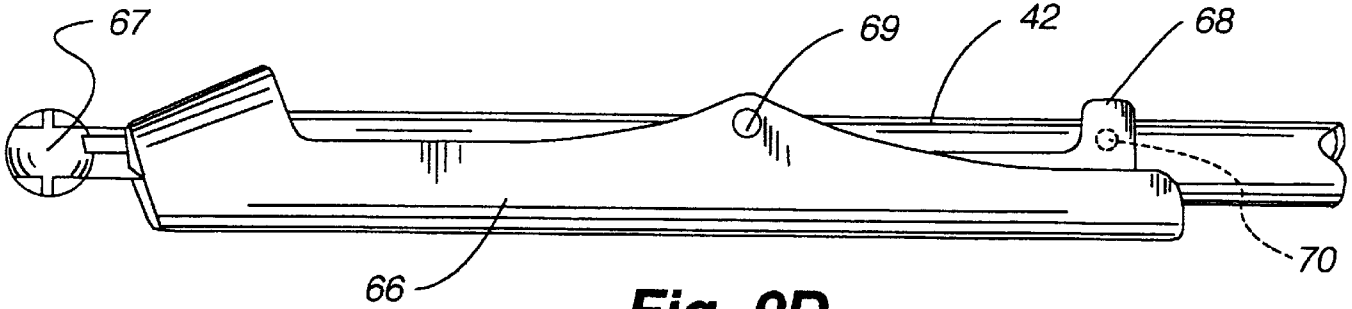
FIG. 9D is a side elevation view showing the support pole and toggle release in the extended position.
Figure 9E:
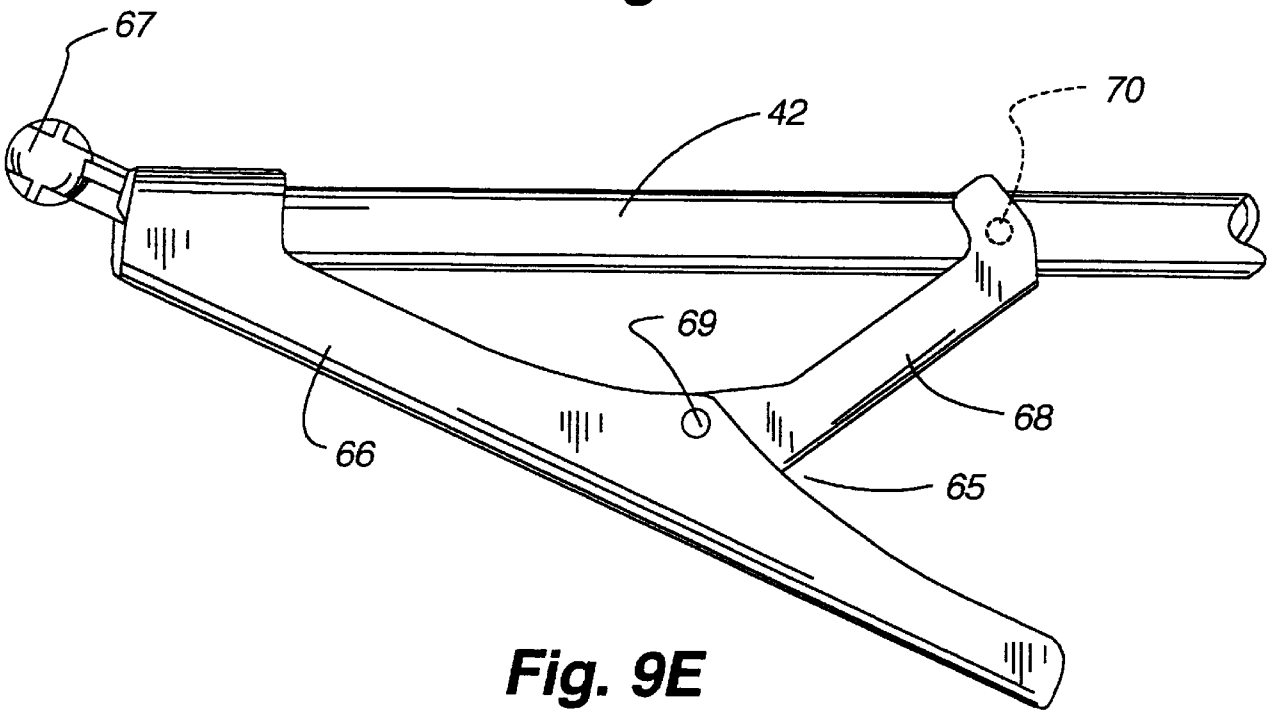
FIG. 9E is a side elevation view showing the support pole and toggle release in the retracted position.

Release toggle 65 is attached to outer pole 42 and aids removal of the slip form 10 from a block of snow or ice formed in cavity 17. By pulling the interior side wall 12 in the direction of the support pole 40, the slip form 10 may be easily moved to an adjacent location, leaving the formed block of snow or ice in place. The release toggle 65 comprises an outer lever 66 (FIGS. 9A and 9B) and an inner lever 68 (FIG. 9C). The outer lever 66 comprises ball connector 67, which inserts into socket 25 to form a connection between the slip form 10 and support pole 40. The outer lever 66 also connects to inner lever 68 via pins 69, which are inserted through opposing sides of outer lever 66 and inner lever 68. Inner lever 68 is connected to outer support pole 42 by pins 70, which are inserted through opposing sides on inner lever 68 and outer support pole 42. As illustrated in FIGS. 9D and 9E, the release toggle 65 dislocates the interior side wall 12 from the block by shortening the overall length of the support pole 40 when the release toggle 65 is moved from its extended position (FIG. 9D) to its retracted position (FIG. 9E).

Figure 8:
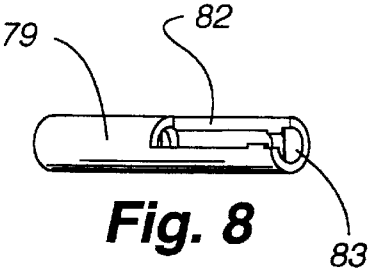
FIG. 8 is a perspective view showing the socket adapter that connects the support pole to the slip form.

Outer support pole 43 connects to the spike 80. Outer support pole 43 comprises a socket adapter 79 which receives ball connector 81 integrated into the construction of spike 80. The socket adapter 79 is a sleeve with a cylindrical shape that has an inner diameter that slightly exceeds the outer diameter of support pole 43, thus socket adapter 79 may be placed over the end of outer support pole 43 and attached. As shown in FIG. 8, socket adapter 79 comprises a slotted aperture 82 which allows ball connector 81 to be inserted and retained by socket 83. Once spike 80 is driven into a firm surface and socket adapter 79 is attached to ball connector 81, support pole 40 is able to rotate freely around a fixed reference point defined by spike 80.

In the preferred embodiment, the elements of the present invention may be constructed from any impact resistant materials that are capable of withstanding cold weather, such as plastic, nylon, or fiberglass reinforced synthetic resin. The support pole 40 may also be constructed from such materials, or may include aluminum, titanium, or other lightweight, durable materials that are strong and capable of withstanding cold temperatures.

The present invention may be used as follows to construct a snow or ice shelter having an ellipsoidal or other desired shape. Spike 80 is driven into a firm surface. The surface may be snow, ice, or earth. The support pole 40 is attached to the anchor or spike 80 or anchor via socket adapter 79. The support pole 40 is attached to the slip form 10 via release toggle 65. Support pole 40 is adjusted with the spring loaded pin 44 inserted into aperture 49 at location 45. The slip form 10 is used to form a ramp of contiguous building blocks of snow or ice arranged in a course forming a circle around the spike 80. Each block has increased height until a full sized block is constructed at the point of beginning. The slip form 10 is then used to form a spiral of circular courses of contiguous building blocks of snow or ice. As each block is finished, the release toggle 65 is used to release the slip form 10 from the block. Once a course is completed, the length of the support pole 40 is adjusted or shortened by placing the spring loaded pin into the next designated aperture 49. The next course of contiguous blocks is formed on top of the previous course, and the length of the support pole 40 is again adjusted or shortened by placing the spring loaded pin 44 in the next designated aperture 49. This process is performed for a plurality of separate courses, each course completing a full circle. The number of courses is dictated by the dimensions of the slip form 10 and the desired dimension of the shelter. In the preferred embodiment, eight courses have been used. One for each aperture 49 located on outer support pole 43. The first course is completed with the spring loaded pin 44 inserted in the aperture at location 45. Subsequent courses are repeated with the spring loaded pin 44 inserted in each of the remaining apertures 49, continuing through aperture 49 at location 26. The exterior side wall 14 and cross member 16 may be removed after the fourth or fifth course is complete and the top or roof is started to be formed. The end cap 18 may be removed for the final course. The series of apertures 49 are spaced at predetermined locations that adjust the length of support pole 40 to define an ellipsoidal or other desired shape.

While an improved method and apparatus for constructing a snow or ice shelter has been shown and described in detail in this application, it is to be understood that this invention is not to be limited to the exact form disclosed and changes in detail and construction of the various embodiments of the invention may be made without departing from the spirit thereof.

We claim:

1. A portable apparatus for constructing a shelter of snow or ice for protection of users against the environment, the structure of said shelter comprised of arching walls which meet to form a roof, said apparatus comprising:

a) a forming means for shaping in situ a plurality of building blocks by packing snow or ice within said forming means, said building blocks comprising the walls of said shelter;

b) a positioning means removably connected to said forming means and pivotally connecting said forming means to a fixed reference point located at the center of said shelter, said positioning means providing a variable radial length for sequentially and uniformly placing said forming means wherein said building blocks may be sequentially formed and uniformly placed in a circular configuration around the reference point and stacked in successive layers to form the walls of said shelter; and c) said positioning means and forming means being connected by a removable swivel means which allows the forming means to be connected or disconnected and rotate and pivot with respect to said positioning means.

2. An apparatus for constructing a shelter as defined in claim 1, wherein said positioning means further comprises a release means connecting said positioning means to said forming means, said release means capable of changing the radial length of the positioning means and releasing the forming means from the packed snow or ice within said forming means, thereby allowing for ease of separation of the forming means from the formed building block and movement to the next building block position.

3. An apparatus for constructing a shelter as defined in claim 1, wherein said positioning means comprises an alignment pole having adjustable length.

4. An apparatus for constructing a shelter as defined in claim 3, wherein said alignment pole is capable of being adjusted to a plurality of predetermined lengths.

5. An apparatus for constructing a shelter as defined in claim 4, wherein said alignment pole further comprises at least first and second telescoping sections having a coaxial longitudinal axis, the outer diameter of said second section being smaller than the inner diameter of said first section, said first section comprising a series of apertures spaced along the longitudinal axis that receive a spring-loaded tab integrated into said second section, thereby fixing the variable length of said pole when said tab is received into an aperture.

6. An apparatus for constructing a shelter as defined in claim 1, further comprising an anchor connected to said positioning means for attaching said positioning means to said reference point.

7. An apparatus for constructing a shelter as defined in claim 6, further comprising a swivel connecting means for pivotally connecting said anchor to said positioning means.

8. An apparatus for constructing a shelter as defined in claim 6, wherein said anchor comprises a spike capable of being driven into snow, ice, or the ground.

9. An apparatus for constructing a shelter as defined in claim 1, wherein said forming means comprises a slip form.

10. An apparatus for constructing a shelter as defined in claim 9 wherein said slip form further comprises:

a) a first side having an inner surface which is vertically oriented, first and second lateral edges, and an outer surface to which said positioning means connects;

b) a second side having an inner surface which is vertically oriented, said inner surface of said first side being in a parallel and opposing relationship with said inner surface of said second side, thereby creating a cavity in between, and further having lateral edges corresponding to the first and second lateral edges of said first side; and c) a third side having a first vertical edge, a second vertical edge, and a bottom edge, said third side being positioned perpendicular to said first and second sides, said first edge removably connected to the first lateral edge of said first side and said second edge removably connected to the corresponding lateral edge of said second side.

11. An apparatus for constructing a shelter as defined in claim 10, wherein said inner surface of said first side and said inner surface of said second side are textured to engage snow or ice when packed into said slip form.

12. An apparatus for constructing a shelter as defined in claim 10, wherein said inner surface of said first side is convex and said inner surface of said second side is concave, said first side and said second side defining a cavity having an arcuate shape.

13. An apparatus for constructing a shelter as defined in claim 10, wherein said first lateral edge of said first side and said corresponding lateral edge of said second side include a plurality of posts, said first edge and said second edge of said third side include a plurality of clasping means corresponding to said posts, and said third side connects to said first side and said second side by securing said posts within said clasping means.

14. An apparatus for constructing a shelter as defined in claim 10, further comprising a cross member arranged in a parallel relationship with said third side on the opposite ends of said first and second sides from said third side, said cross member removably connected between said first side and said second side.

15. An apparatus for constructing a shelter as defined in claim 14, wherein said first side includes a first slot and said second side includes a second slot, and said cross member attaches to said first side and said second side by slidably inserting said cross member into said first and second slots.

16. An apparatus for constructing a shelter as defined in claim 10, wherein said bottom edge of said third side further comprises a guiding means for guiding the movement of said slip form as said slip form is moved to a new position.

17. An apparatus for constructing a shelter as defined in claim 16, wherein said guiding means comprises a ski having a longitudinal axis and a keel, said ski being arranged perpendicular to said third side, said keel positioned at an angle from the axis of the ski to define an arc through which said slip form is moved.

18. A portable apparatus for constructing a shelter of snow or ice for protection of users against the environment, said apparatus comprises:

a) a slip form, said slip form including:

1. a first side having inner and outer surfaces and first and second lateral edges;
2. a second side having inner and outer surfaces, said inner surface of said second side being positioned in a parallel and opposing relationship with said inner surface of said first side thereby creating a cavity in between and further having first and second lateral edges corresponding to the first and second lateral edges of the first side; and
3. a third side having a first edge, a second edge, and a bottom edge, said third side being positioned perpendicular to said first and second sides, said first edge removably connected to the first lateral edge of said first side and said second edge removably connected to the corresponding lateral edge of said second side; and b) an elongated slip form positioning means having first and second ends, the first end of the positioning means being pivotally connected to an anchor means secured so as to locate the center of the shelter and the second end attached to the outside surface of either the first or second side by a removable swivel means which allows connection and disconnection and pivotal and rotational movement between the slip form positioning means and the slip form.

19. An apparatus for constructing a shelter as defined in claim 18, wherein said slip form further comprises a cross member arranged in a parallel and opposing relationship with said third side and on opposite ends of said first and second sides from said third side, said cross member removably connected between said first side and said second side.

20. An apparatus for constructing a shelter as defined in claim 18, wherein inner surface of the first side of the slip form and said inner surface of the second side of the slip form are textured to engage snow or ice when packed into said slip form.

21. An apparatus for constructing a shelter as defined in claim 18, wherein said inner surface of the first side of the slip form is convex and the inner surface of said second side of the slip form is concave, said first side and said second side defining a cavity having an arcuate shape, whereby said building blocks formed therein create arching walls which meet to form a domed structure for said shelter and said positioning means is attached to said first side.

22. An apparatus for constructing a shelter as defined in claim 18, wherein said bottom edge of the third side of the slip form further comprises a guiding means for guiding the movement of said slip form as said slip form is moved to a new position.

23. A portable apparatus for constructing a shelter of snow or ice for protection of users against the environment, said apparatus comprising a slip form positioning means and a slip form for forming insitu building blocks of snow or ice, which building blocks are used to construct the walls of said shelter, said slip form further comprises:

a) a first side having an inner and outer surface which are vertically oriented and first and second lateral edges;

b) a second side having an inner and outer surface which are vertically oriented, said inner surface of said second side being positioned in a parallel and opposing relationship with said inner surface of said first side thereby creating a cavity inbetween, and further having lateral edges corresponding to the first and second lateral edges of the first side;

c) a third side having a first vertical edge, a second vertical edge, and a bottom edge, said third side being positioned perpendicular to said first and second sides, said first vertical edge removably connected to the first lateral edge of said first side and second vertical edge removably connected to the corresponding lateral edge of said second side; and d) the bottom edge of the third side of the slip form further includes a guide means for guiding the movement of said slip form when it is moved to a new position, said guide means further comprising a ski having a longitudinal axis and a keel, said ski being arranged perpendicular to said third side, said keel being positioned at an angle with the axis of the ski to define an arc through which said slip form can be moved.

24. A portable apparatus for constructing a shelter of snow or ice for protection of users against the environment, said apparatus comprising a slip form positioning means and a slip form for forming insitu building blocks of snow or ice, which building blocks are used to construct the walls of said shelter, said slip form further comprising;

a) a first side having an inner and outer surface which are vertically oriented and first and second lateral edges;

b) a second side having an inner and outer surface which are vertically oriented, said inner surface of said second side being positioned in a parallel and opposing relationship with said inner surface of said first side thereby creating a cavity inbetween, and further having lateral edges corresponding to the first and second lateral edges of the first side;

c) a third side having a first vertical edge, a second vertical edge, and a bottom edge, said third side being positioned perpendicular to said first and second sides, said first edge removably connected to the first lateral edge of said first side and said second edge removably connected to the corresponding lateral edge of said second side; and d) the first lateral edge of said first side of the slip form and said corresponding lateral edge of said second side of the slip form including a plurality of posts, said first vertical edge and said second vertical edge of the third side of the slip form including a plurality of clasping means corresponding to said posts, and said third side connects to said first side and said second side by securing said posts within said clasping means.

25. A portable apparatus for constructing a shelter of snow or ice for protection of users against the environment, said apparatus comprising a slip form positioning means and a slip form for forming insitu building blocks of snow or ice, which building blocks are used to construct the walls of said shelter, said slip form further comprising:

a) a first side having an inner and outer surface which are vertically oriented and first and second lateral edges;

b) a second side having an inner and outer surface which are vertically oriented, said inner surface of said second side being positioned in a parallel and opposing relationship with said inner surface of said first side thereby creating a cavity inbetween, and further having lateral edges corresponding to the first and second lateral edges of the first side;

c) a third side having a first vertical edge, a second vertical edge, and a bottom edge, said third side being positioned perpendicular to said first and second sides, said first edge removably connected to the first lateral edge of said first side and said second edge removably connected to the corresponding lateral edge of said second side;

d) said slip form further comprising a cross member arranged in a parallel and opposing relationship with said third side and on the opposite ends of said first and second sides from said third side, said cross member removable connected between said first side and said second side; and e) said first side further includes a first slot and said second side further includes a second slot, and said cross member attaches to said first side and said second side by slidably inserting said cross member into said first and second slots.

* * * * *